US006010354A

United States Patent [19]

Cunningham

[11] Patent Number: 6,010,354

[45] Date of Patent: Jan. 4, 2000

[54] DOCKING I/O CONNECTOR SYSTEM

[75] Inventor: Adam Douglas Cunningham, Methuen, Mass.

[73] Assignee: The Whitaker Corporation, Wilmington, Del.

[21] Appl. No.: 09/130,942

[22] Filed: Aug. 7, 1998

[51] Int. Cl.[7] ..... H01R 4/24

[52] U.S. Cl. ..... 439/417; 439/465

[58] Field of Search ..... 439/417, 404, 439/405, 465, 467

[56] References Cited

U.S. PATENT DOCUMENTS

| | | | |
|---|---|---|---|
| 4,225,205 | 9/1980 | Sinclair | 439/467 |
| 4,781,615 | 11/1988 | Davis et al. | 439/395 |
| 5,123,859 | 6/1992 | Davis et al. | 439/405 |
| 5,505,637 | 4/1996 | Kramer et al. | 439/467 |
| 5,601,447 | 2/1997 | Reed et al. | 439/465 |
| 5,643,005 | 7/1997 | Weidler et al. | 439/405 |
| 5,676,569 | 10/1997 | Davis | 439/731 |
| 5,820,412 | 10/1998 | Koegel et al. | 439/610 |

*Primary Examiner*—Gary F. Paumen

[57] ABSTRACT

A connector includes a housing assembly, a backshell and a latch. The housing assembly includes a plurality of contacts having IDC sections for connection to a plurality of discrete electrical conductors. The backshell engages the housing assembly and includes a retention row for urging the discrete electrical conductors into electrical contact with the IDC sections. The backshell grips a cable holding the discrete electrical conductors to provide a strain relief and provides an interior cavity suitable for splaying the discrete electrical conductors to the plurality of IDC sections. The latch is coupled to the housing assembly and is adapted for engagement with a mating connector to retain the housing assembly in engagement with the mating connector.

25 Claims, 2 Drawing Sheets

DOCKING I/O CONNECTOR SYSTEM

BACKGROUND OF THE INVENTION

1. Field of the Invention

This invention relates generally to electrical cable connectors and more particularly, to connectors for terminating discrete electrical conductors.

2. Description of the Related Art

Electrical connectors exist in a wide variety of forms and contain a variety of different features. Generally, connectors may be classified as male, or plug, and female, or receptacle. A female, or receptacle, connector may include a slot in which are located a plurality of contacts, each of which will typically be coupled to an electrical conductor. A male, or plug, connector may include a blade having a plurality of contacts on one or more surfaces, and each of the contacts on the blade will typically terminate in an electrical conductor. The blade portion of the plug connector is adapted for insertion into the slot of the receptacle connector, resulting in a mating between the contacts of the receptacle connector and the contacts of the plug connector. Thus, electrical connectivity may be established between electrical conductors coupled to the receptacle connector and electrical conductors coupled to the plug connector.

SUMMARY OF THE INVENTION

In one aspect of the present invention, a connector includes a housing assembly having a plurality of contacts each having an insulation displacement ("IDC") section adapted for termination to a corresponding plurality of discrete electrical conductors. The invention further comprises a latch coupled to the housing assembly, the latch adapted for engagement with a mating connector to retain the housing assembly in engagement with the mating connector. A backshell has two halves, each half including a retention post for engagement to couple the housing assembly to the backshell. Each backshell half also includes a retention row for substantial alignment with at least a portion of the IDC sections, and the retention row is adapted to urge the discrete electrical conductors into electrical contact with the IDC sections. The housing has an interior cavity to receive the plurality of discrete electrical conductors for splaying to the plurality of IDC sections.

BRIEF DESCRIPTION OF THE DRAWINGS

The invention may be best understood by reference to the following description taken in conjunction with the accompanying drawings, in which like reference numerals identify like elements, and in which.

Figure 1:
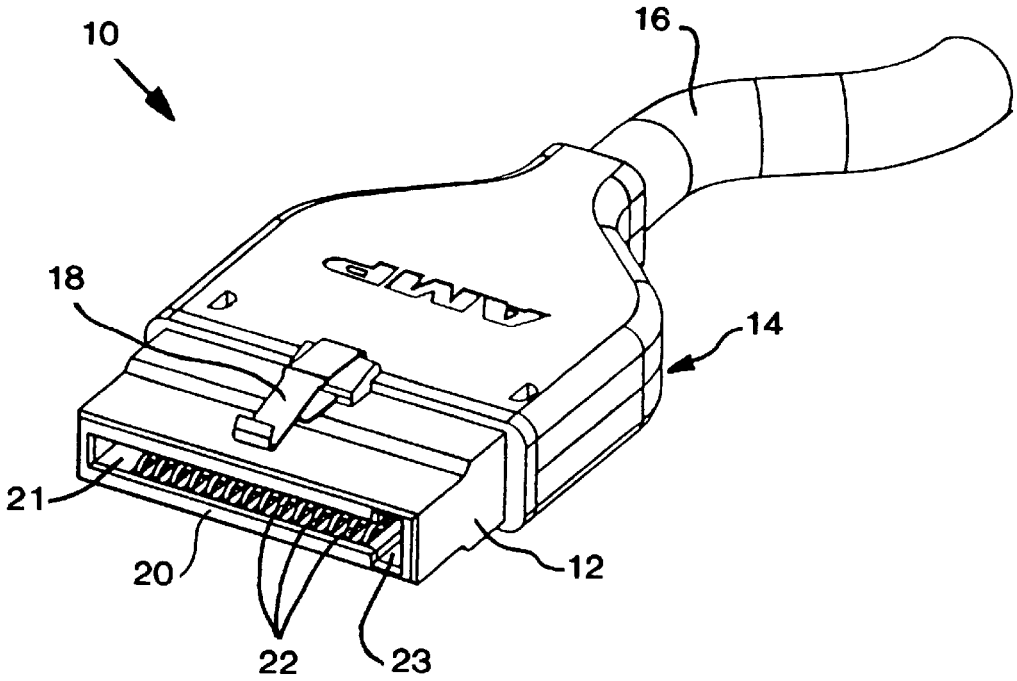
FIG. 1 is an isometric view of a cable connector incorporating features of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 shows one embodiment of a cable receptacle connector 10 according to the present invention. In practice, the cable receptacle 10 will typically be mated with a plug to electrically couple conductors in the cable to electrical conductors attached to the plug. The cable receptacle 10 includes a housing assembly 12, coupled to a backshell assembly 14. The backshell assembly 14, as will be described in more detail below, facilitates connection between individual conductors in a round cable 16 and IDC sections (described below) in the housing assembly 12. The backshell assembly 14 also grips the cable and provides strain relief for the interconnection between the conductors in the round cable 16 and the IDC sections in the housing assembly 12. The housing assembly 12 has coupled to it a thumb latch 18 which, as will be seen, may be used to lock the cable receptacle 10 to a mating plug assembly (not shown). At a leading face 20 of the housing assembly 12 is a receptacle opening 21 that is adapted to receive the contact blade from a mating plug assembly. The opening 21 may include an enlarged section 23 that is designed to receive a polarization and alignment flange on the mating plug assembly to ensure proper orientation and mating between the cable receptacle 10 and the mating plug assembly. Located in the opening 21 are contact sections 22 of contacts 34 arranged in a row across the opening 21. The contact sections 22 are adapted to mate with individual contact surfaces in the mating plug assembly. A representative plug assembly will be described below. A variety of electrical and physical connector interfaces may be employed in conjunction with the present invention.

Figure 2:
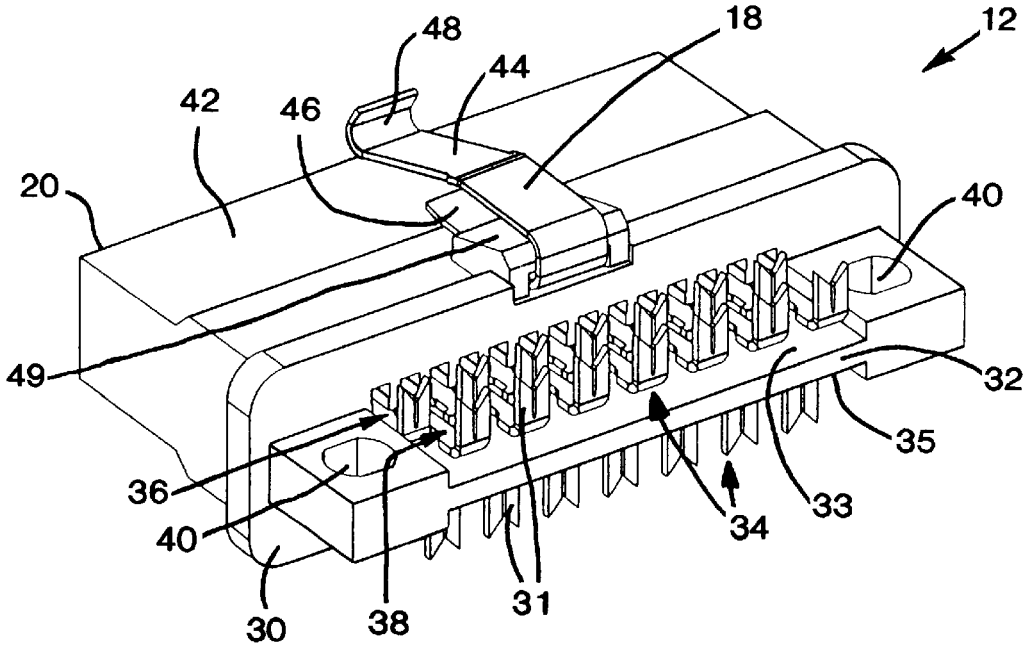
FIG. 2 is an isometric view of a connector housing assembly portion of the cable connector of FIG. 1.

FIG. 2 shows the housing assembly 12 of FIG. 1 in greater detail. The housing assembly 12 includes a leading face 20 and a back face 30. The back face 30 is adapted to abut a corresponding face 60 (see FIG. 3) on the backshell assembly 14, as will be more fully described below. Protruding from the back face 30 is a contact mounting surface 32. The contact mounting surface 32 includes two assembly holes 40 that are designed for cooperation with retention posts 52 (see FIG. 3) in the backshell assembly 14. As will be described in connection with FIG. 3, the retention posts 52 in the backshell assembly 14 extend through the assembly holes 40 to retain the housing assembly 12 against the backshell assembly 14. The contact mounting surface 32 includes a top surface 33 and a bottom surface 35. Each of the top surface 33 and bottom surface 35 have mounted thereon two rows 36, 38 of IDC sections 31 of connector contacts 34. In the particular housing assembly 12 illustrated in FIG. 2, a first, inside row 36 of IDC sections 31 of connector contacts 34 includes seven IDC sections 31. A second, outside row 38 of IDC sections 31 of connector contacts 34 also includes seven IDC sections. As shown in FIG. 2, the IDC sections 31 of the connector contacts 34 in the first and second rows 36, 38 are staggered such that alternating IDC sections 31 are in the same row 36 or 38. The bottom surface 35 of the contact mounting surface 32 also includes two rows of seven IDC sections 31 of connector contacts 34 each, arranged as are the two rows 36, 38 on the top surface 33. Although the housing assembly 12 shown in FIG. 2 includes 28 connector contacts 34, any number of contacts may be used.

The housing assembly 12 includes an upper surface 42 on which is mounted the thumb latch 18. The thumb latch 18 is coupled to the upper surface 42 by means of a thumb latch bracket 49. The thumb latch 18 is generally U-shaped with one leg 44 terminating in a hook 48 and being longer than the other leg 46. The leg 44 floats above the surface 42; that is, when the latch 18 is not engaged with a mating hook, a gap exists between the leg 44 and the surface 42. The latch 18 is designed for engagement with a housing of a mating plug assembly, as will be more fully described below. The hook 48 provides a convenient means for manually engaging and disengaging the housing assembly 12 from a mating plug assembly.

Figure 3:
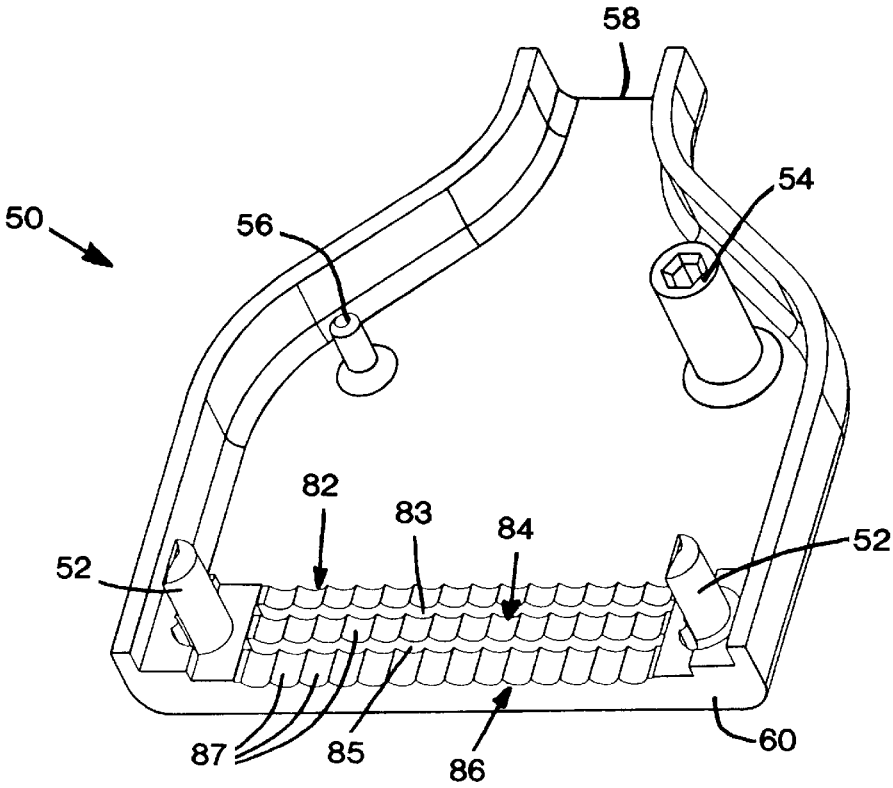
FIG. 3 is an isometric view of one half of the backshell assembly of the cable connector of FIG. 1.

FIG. 3 shows one half 50 of the backshell assembly 14 illustrated in FIG. 1. The backshell assembly 14 of FIG. 1 comprises two halves, each represented by the half 50 shown in FIG. 3. The backshell half 50 includes two retention posts 52 each of which is semi-cylindrical in shape. The retention posts 52 are designed for engagement with the assembly holes 40 in the contact mounting surface 32 shown in FIG. 2. As will be appreciated, when the two backshell halves 50 are assembled to make the backshell assembly 14, the semi-cylindrical posts 52 in one backshell half 50 will complement the semi-cylindrical retention posts 52 in the second backshell half to form two cylindrical posts that are dimensioned for engaging the assembly holes 40 in a force fit. Thus assembled, the retention posts 52 will ensure locking engagement between the housing assembly 12 and the backshell assembly 14. The backshell half 50 includes a contact end 60 which will abut the backface 30 of the housing assembly 12 illustrated in FIG. 2.

The backshell half 50 also includes an assembly post receptacle 54 and an assembly post plug 56. When the two backshell halves 50 are assembled to make up the backshell assembly 14, the assembly post plug 56 from one backshell half 50 will engage the assembly post receptacle 54 of the second backshell half 50 in a press fit, snapping engagement to lock the two backshell halves 50 together to form the backshell assembly 14. The backshell half 50 includes a cable end 58 at which an opening will accommodate the round cable 16 shown in FIG. 1. When the two backshell halves 50 are assembled to form the backshell assembly 14, the opening 58 will grip the cable 16 to provide a strain relief for the electrical connections at the IDCs 34. Ribs or threads may be formed in the opening 58 to enhance the grip of the assembled opening 58 on the cable 16 and improve the ability of the backshell assembly 14 to provide a strain relief. In one embodiment, the backshell half 50 includes a generally fan-shaped interior cavity to provide a space to splay the individual conductors from the cable 16 to facilitate their interconnection with the IDC sections 31 of the connector contacts 34, seen in FIG. 2. In general, the backshell assembly 14 may be of any size or configuration.

The backshell half 50 includes three rows 82, 84, 86 forming two gaps 83, 85 therebetween. Each of the rows 82, 84 and 86 preferably comprise a plurality of generally semicircular, or scalloped, recesses, ribs or tracks 87. The recesses, ribs or tracks 87 assist in splaying the individual conductors from the cable 16 to the IDC sections 31 of the connector contacts 34. The scalloped recesses 87 may also be formed in one backshell half 50 in such a way as to grip the individual conductors and hold them in place while the cable receptacle 10 is assembled. For example, the recesses 87 may subtend an arc of greater than 1800 so that a conductor may easily be pressed into a recess 87 and be retained in the recess 87 to ease assembly of the cable receptacle 10. The rows 82, 84, 86 also serve to urge the individual conductors into proper engagement with the IDC sections 31. In alternative embodiments of the invention, the rows 82, 84, 86 may be flat, without the recesses 87, and still perform the function of urging the discrete conductors into electrical contact with the IDC sections 31. The two gaps 83, 85 are situated to receive the two rows 36, 38 of IDC sections 31 shown in FIG. 2 when the backshell half 50 is coupled to the housing assembly 12. Each of the scalloped recesses 87 in each row 82, 84, 86 will accommodate and complement a single conductor from the round cable 16. When the backshell half 50 is assembled with the housing assembly 12, the two rows 36, 38 of the IDC sections 31 of the connector contacts 34 will enter the gaps 83, 85, and the three rows 82, 84, 86 of scalloped recesses 87 will urge the individual conductors from the round cable 16 into the IDC sections 31, shown in FIG. 2, establishing electrical connection between each discrete conductor and its respective IDC section 31 and connector contact 34. As pointed out above, the number of contacts 34 may easily be varied, and the number of rows 82, 84, 86 and gaps 83, 85 may vary as well. As already mentioned, when the two backshell halves 50 are assembled to form the backshell assembly 14, the backshell assembly 14 will provide a strain relief for the connections between the individual conductors in the round cable 16 and the IDC sections 31 by gripping the cable 16 at the opening 58.

Figure 4:
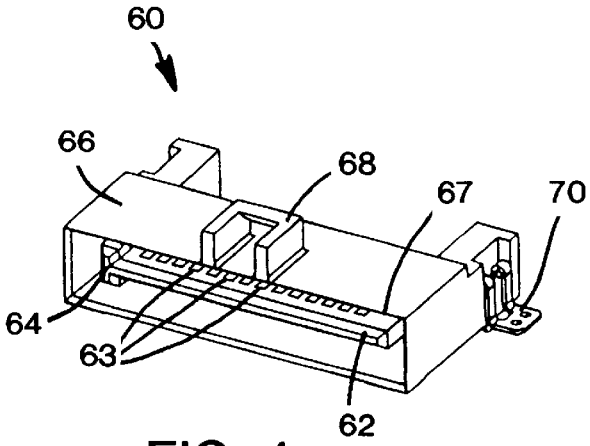
FIG. 4 is an isometric view of one embodiment of a plug assembly that may be used with the cable connector of FIG. 1.

FIG. 4 shows one embodiment of a plug assembly 60 that may be used to mate with the cable receptacle 10 shown in FIG. 1. The plug assembly 60 includes a plug housing 66 that forms a shield around a contact blade 62. The front portion 67 of the housing 66 protects the contacts 63 on the contact blade 62 from dust and prevents a user from accidentally touching the contacts 63. The front portion 67 also facilitates coupling of the plug assembly 60 with the cable receptacle 10 by providing a lead-in to the housing 66 for the receptacle 10. The contact blade 62 has mounted on each of its top and bottom surfaces a row of contacts 63. The contacts 63 are adapted for engagement with the connector contacts 22 in the cable receptacle 10 shown in FIG. 1. At one end of the contact blade 62 is a polarization and alignment flange 64 that is designed for engagement with the enlarged opening 23 in the housing assembly 12 of the cable receptacle 10 shown in FIG. 1. The flange 64 and the enlarged opening 23 cooperate to ensure proper orientation and mating between the plug assembly 60 and the cable receptacle 10. Mounted on the plug housing 66 is a thumb latch receptacle 68 that cooperates with the thumb latch 18 on the cable receptacle 10 for a locking engagement between the plug assembly 60 and the cable receptacle 10. Specifically, the thumb latch 18 (see FIG. 2) may be depressed toward the surface 42 and, as the cable receptacle 10 and the plug assembly 60 are engaged, the thumb latch 18 may be made to pass under and through the thumb latch receptacle 68. As the cable receptacle 10 and plug assembly 60 are fully engaged, the thumb latch 18 may be released and, because it is biased away from the upper surface 42 of the housing assembly 12, the thumb latch 18 will spring back up against the under portion of the thumb latch receptacle 68. The hook 48 will engage the thumb latch receptacle 68 and prevent unintended separation of the plug assembly 60 and the cable receptacle 10. To separate the cable receptacle 10 and the plug assembly 60, the thumb latch 18 may be depressed and again allowed to pass through the thumb latch receptacle 68. The plug assembly 60 also includes hold downs 70 on each side of the plug housing 66 to provide a convenient means for mounting the plug assembly 60 to a printed circuit board, for example.

Figure 5:
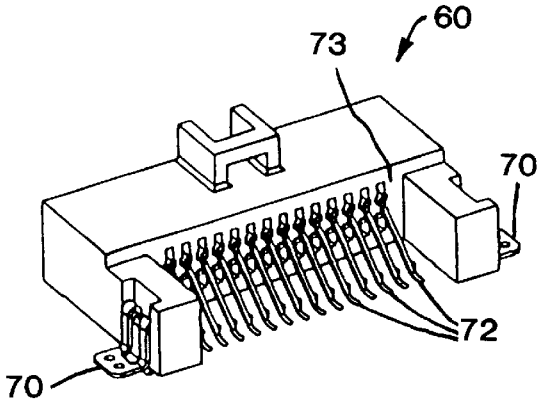
FIG. 5 is a rear isometric view of the plug assembly of FIG. 4.

FIG. 5 shows the plug assembly 60 from a rear view. As may be seen from FIG. 5, conductor contacts 72 protrude from a rear face 73 of the housing 66. As will be well understood by those of ordinary skill in the art, each of the conductor contacts 72 facilitates the connection between an electrical conductor external of the plug assembly 60 and one of the contacts 63 in the plug assembly 60.

As will be appreciated by those of ordinary skill in the art, other types of plug assemblies may be used with the cable receptacle 10 shown in FIG. 1. As will also be appreciated by those of ordinary skill in the art, other housing assemblies may be used in place of the particular housing assembly 12 shown in FIG. 1. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A connector, comprising:

a housing assembly having a plurality of contacts adapted for engagement with a corresponding plurality of discrete electrical conductors;

a latch coupled to the housing assembly and adapted for engagement with a mating connector to retain the housing assembly in engagement with the mating connector;

a backshell having two halves, the backshell including at least one retention post for engagement with the housing assembly to couple the housing assembly to the backshell, each backshell half including at least one retention row for urging at least a portion of the discrete electrical conductors into electrical contact with at least a portion of the contacts, the backshell having an interior cavity to receive the plurality of discrete electrical conductors for splaying to the plurality of contacts.

2. The connector of claim 1, wherein the at least one retention row further comprises a plurality of recesses, each recess adapted to receive one of the discrete electrical conductors and align the discrete electrical conductors with one of the contacts.

3. The connector of claim 2, wherein each of the plurality of recesses subtends an arc of greater than 180° and wherein each of the plurality of recesses is adapted to retain one of the discrete electrical conductors.

4. The connector of claim 2, further comprising at least one row of connector contacts, each connector contact being electrically coupled to one of the contacts and adapted for mating engagement with an electrical contact in a mating connector.

5. The connector of claim 1, wherein the housing assembly includes at least two rows of IDC sections of the contacts, and wherein the backshell includes at least two gaps, each of the gaps adapted to receive at least one of the at least two rows of IDC sections.

6. The connector of claim 5, wherein each backshell half includes at least two retention rows forming at least one gap, each gap adapted to receive at least one row of IDC sections.

7. The connector of claim 6, wherein the housing assembly includes 28 IDC sections arranged in four rows of seven IDC sections each, and wherein each backshell half includes three retention rows forming two gaps, each gap adapted to receive one row of seven IDC sections.

8. The connector of claim 1, wherein the backshell is adapted to forcibly engage the plurality of discrete electrical conductors to provide a strain relief at the electrical contact between the discrete electrical conductors and the contacts.

9. The connector of claim 1, wherein the backshell is adapted to receive a cable having the plurality of discrete electrical conductors, the backshell adapted to forcibly engage the cable to provide a strain relief for the electrical contact between the discrete electrical conductors and the contacts.

10. The connector of claim 9, wherein the backshell further comprises an opening adapted to receive the cable, the opening having ribs formed therein, the ribs adapted to grip the cable and provide a strain relief.

11. A connector system, comprising:

receptacle housing having a plurality of contacts, the contacts having IDC sections exposed along a termination face of the housing and adapted for electrical engagement with a corresponding plurality of discrete electrical conductors, the contacts also defining at least one row of receptacle contact sections along a mating face of the housing;

a backshell having two halves, the backshell including at least one retention post for engagement with the receptacle housing to couple the receptacle housing to the backshell, each backshell half having first and second retention rows situated in parallel and forming a gap therebetween, the gap adapted to receive at least a subset of the IDC sections when the receptacle housing is coupled to the backshell, the first and second retention rows adapted to urge at least a subset of the discrete electrical conductors into electrical contact with the IDC sections in the gap, the backshell, when assembled, having a generally fan-shaped interior cavity for receiving the plurality of discrete electrical conductors for splaying to the IDC sections;

a latch coupled to the housing;

a plug housing having at least one row of plug contacts for electrical contact with the at least one row of receptacle contacts; and a catch coupled to the plug housing and adapted to engage the latch to retain the plug contacts in electrical contact with the receptacle contacts.

12. The connector system of claim 11, wherein the receptacle housing has 28 contacts with respective IDC sections and 28 receptacle contact sections.

13. The connector system of claim 12, wherein the 28 IDC sections are arranged in four rows of seven IDC sections each.

14. The connector system of claim 13, wherein each backshell half includes three retention rows situated in parallel to form two parallel gaps, each gap adapted to receive one row of seven IDC sections upon assembly of the housing with the backshell halves.

15. The connector system of claim 14, wherein each retention row includes a plurality of recesses, each recess adapted to receive and retain one of the discrete electrical conductors.

16. The connector system of claim 11, wherein the backshell is adapted to receive a cable having a plurality of discrete electrical conductors for terminating to at least a portion of the plurality of IDC sections.

17. The connector system of claim 16, wherein the backshell is adapted to forcibly engage the cable to provide a strain relief for the termination of the discrete electrical conductors to the IDC sections.

18. The connector system of claim 16, wherein the backshell further comprises an opening having ribs formed therein, the opening being adapted to receive the cable and the ribs being adapted to grip the cable to provide a strain relief.

19. A connector assembly, comprising:

a housing having a plurality of contacts having IDC sections for conductor termination thereto;

a latch coupled to the housing and adapted for engagement with a mating connector to retain the housing in engagement with the mating connector;

a backshell having two halves, each backshell half including at least one retention post for engagement with the housing to couple the housing to the backshell, at least one backshell half also including first and second retention rows situated in parallel and forming a gap therebetween, the gap adapted to receive at least a portion of the plurality of IDC sections when the housing is coupled to the backshell, the backshell having an interior cavity; and a generally round cable having a plurality of discrete electrical conductors, the backshell adapted to receive an end of the cable in the interior cavity to provide for splaying the plurality of discrete electrical conductors to respective ones of the IDC sections for electrical engagement therewith, the first and second retention rows adapted to urge the discrete electrical conductors into electrical contact with the IDC sections when the housing is coupled to the backshell halves.

20. The connector assembly of claim 19, wherein at least the first retention row includes a plurality of recesses adapted to receive and retain a corresponding plurality of the discrete electrical conductors.

21. The connector assembly of claim 19, wherein the backshell is adapted to forcibly engage the generally round cable to provide a strain relief of the electrical contact between the discrete electrical conductors and the IDC sections.

22. The connector assembly of claim 19, wherein the backshell further comprises an opening adapted to receive the cable, the opening having ribs formed therein adapted to forcibly grip the cable and provide a strain relief.

23. The connector assembly of claim 19, wherein the housing includes at least two rows of IDC sections, and wherein the backshell includes at least three retention rows forming at least two gaps, each gap adapted to receive at least one row of IDC sections.

24. The connector assembly of claim 23, wherein each backshell half includes at least two retention rows forming at least one gap, each gap adapted to receive at least one row of IDC sections.

25. The connector assembly of claim 19, wherein the housing includes 28 IDC sections arranged in four rows of seven IDC sections each, and wherein each backshell half includes three retention rows forming two gaps, each gap adapted to receive one row of seven IDC sections.

* * * * *